US007661211B2

(12) United States Patent
Potak

(10) Patent No.: US 7,661,211 B2
(45) Date of Patent: Feb. 16, 2010

(54) METHOD AND APPARATUS FOR RAISING A SNOW PLOW

(75) Inventor: Robert L. Potak, Strongsville, OH (US)

(73) Assignee: Louis Berkman Winter Products Company, Cleveland, OH (US)

( * ) Notice: Subject to any disclaimer, the term of this patent is extended or adjusted under 35 U.S.C. 154(b) by 439 days.

(21) Appl. No.: 11/670,886

(22) Filed: Feb. 2, 2007

(65) Prior Publication Data

US 2007/0180739 A1 Aug. 9, 2007

Related U.S. Application Data

(60) Provisional application No. 60/764,590, filed on Feb. 2, 2006.

(51) Int. Cl.
*E01H 5/04* (2006.01)

(52) U.S. Cl. ..... 37/234; 37/231

(58) Field of Classification Search ..... 37/231, 37/232, 233, 266, 268, 270, 235, 279, 283, 37/284, 234; 172/811, 815, 817, 684.5, 772, 172/772.5

See application file for complete search history.

(56) References Cited

U.S. PATENT DOCUMENTS

| | | | | |
|---|---|---|---|---|
| 2,430,221 | A | 11/1947 | Frink et al. | |
| 2,792,550 | A | 5/1957 | Kenyon | |
| 2,991,666 | A | 7/1961 | Sumner et al. | |
| 3,142,197 | A | 7/1964 | Le Tourneau | |
| 3,161,072 | A | 12/1964 | Le Tourneau | |
| 3,412,489 | A | 11/1968 | Klapprodt et al. | |
| 3,524,269 | A | 8/1970 | Jackoboice | |
| 3,845,577 | A | 11/1974 | Naymik | |
| 4,279,084 | A | 7/1981 | Low et al. | |
| 4,357,766 | A | 11/1982 | Croteau et al. | |
| 4,574,502 | A | 3/1986 | Blau | |
| 4,744,159 | A | 5/1988 | Houle | |
| 4,962,598 | A | 10/1990 | Woolhiser et al. | |
| 4,991,323 | A * | 2/1991 | Benkler | 37/235 |
| 5,031,343 | A | 7/1991 | Houle et al. | |
| 5,075,988 | A | 12/1991 | Ciula | |
| 5,125,174 | A | 6/1992 | Watson et al. | |
| RE35,700 | E | 12/1997 | Watson et al. | |
| 6,860,040 | B2 * | 3/2005 | Schultz et al. | 37/231 |
| 6,941,685 | B2 | 9/2005 | Goy et al. | |

OTHER PUBLICATIONS

PCT Notification of Transmittal of the International Search Report and Written Opinion of the International Searching Authority dated Sep. 6, 2007.

PCT International Search Report, European Patent Office, dated Sep. 6, 2007.

PCT Written Opinion of the International Searching Authority, European Patent Office, dated Sep. 6, 2007.

* cited by examiner

*Primary Examiner*—Robert E Pezzuto
(74) *Attorney, Agent, or Firm*—Emerson, Thomson, Bennett; Roger D. Emerson; Timothy D. Bennett

(57) ABSTRACT

A snowplow assembly includes an adjustment mechanism for use in adjusting the position of a snowplow frame member on a lift frame member into at least two positions:

(1) a first position where the snowplow frame member is on the bottom portion of the lift frame member, the snowplow is positioned to plow snow, and the snowplow operation axis is substantially parallel to a ground surface; and, (2) a second position where the snowplow frame member is on the top portion of the lift frame member and the snowplow operation axis is at an angle A1 that is between 10° and 90° with respect to the ground surface.

26 Claims, 17 Drawing Sheets

METHOD AND APPARATUS FOR RAISING A SNOW PLOW

This application claims priority to U.S. Ser. No. 60/764,590 entitled Method and Apparatus For Plow Without Auxiliary Light Kit, filed Feb. 2, 2006.

I. BACKGROUND OF THE INVENTION

A. Field of Invention

This invention pertains to the art of methods and apparatuses for snowplows and more specifically to methods and apparatuses for raising a snowplow such that when it is in the raised position it is angled out of the way of the vehicle's headlights. This invention makes separate snowplow lights unnecessary.

B. Description of the Related Art

It is well known to provide snowplow assemblies for use in moving snow and ice from roads, driveways, parking lots and other such surfaces. Typically, the snowplow assembly is attached to a vehicle such as a pickup truck. Usually, the snowplow can be moved by the driver/operator of the vehicle by manipulating a control system within the occupant compartment of the vehicle. While numerous snowplow movements may be possible depending on the particular design of the snowplow assembly and the related controls, snowplow movement nearly always includes an adjustment between a lowered "use" position, where the snowplow can be used to plow snow from a ground surface, and a raised "transport" position, where the snowplow can be transported (without contacting any ground surface) by the vehicle until use of the snowplow is again required.

Generally, snowplow assemblies include: (1) a support frame that can be connected to the vehicle; (2) a snowplow frame that supports a snowplow and that is pivotally connected to the support frame; and, (3) an adjustment mechanism, usually including a hydraulic system, for use in adjusting the position of the snowplow frame member. To adjust the snowplow from the use position to the transport position, the snowplow frame (and thus the snowplow) is raised causing it to pivot about the support frame.

While such known snowplow assemblies generally work well for their intended purpose, they have disadvantages. One disadvantage is that while the snowplow is in the raised transport position, it interferes with the light beams coming from the vehicle's head lights. To solve this problem, it is well known to provide an auxiliary lighting system as part of the snowplow assembly. While this option solves the lighting problem, it is costly and cumbersome to install.

The present invention includes embodiments that solve the snowplow related lighting problem, as well as other problems, in a new way that eliminates the need for an auxiliary lighting system.

II. SUMMARY OF THE INVENTION

According to one embodiment of this invention, a method of adjusting a snowplow comprises the steps of:

(a) providing a snowplow assembly comprising: (1) a support frame for use in connecting the snowplow assembly to an associated vehicle; (2) at least one lift frame member having a top portion and a bottom portion operatively connected to the support frame; (3) at least one snowplow frame member that engages the lift frame member; (4) a snowplow operatively connected to the snowplow frame member and having a snowplow operation axis; and, (5) an adjustment mechanism for use in adjusting the position of the snowplow frame member on the lift frame member;

(b) lowering the snowplow frame member to the bottom portion of the lift frame member where the snowplow is positioned to plow snow and the snowplow operation axis is substantially parallel to a ground surface;

(c) raising the snowplow frame member to the top portion of the lift frame member; and, (d) pivoting the snowplow frame member on the top portion of the lift frame member where the snowplow operation axis is at an angle A1 that is between 10° and 90° with respect to the ground surface.

According to another embodiment of this invention, a snowplow assembly comprises:

a support frame for use in connecting the snowplow assembly to an associated vehicle;

a first lift frame member having a top portion and a bottom portion operatively connected to the support frame;

a first snowplow frame member that engages the first lift frame member;

a snowplow operatively connected to the first snowplow frame member and having a snowplow operation axis; and, an adjustment mechanism for use in adjusting the position of the first snowplow frame member on the first lift frame member into at least two positions:

(1) a first position where the first snowplow frame member is on the bottom portion of the first lift frame member, the snowplow is positioned to plow snow, and the snowplow operation axis is substantially parallel to a ground surface; and, (2) a second position where the first snowplow frame member is on the top portion of the first lift frame member and the snowplow operation axis is at an angle A1 that is between 10° and 90° with respect to the ground surface.

One advantage of this invention is that the need for auxiliary snowplow lights is eliminated.

Another advantage of this invention is that snowplow assembly costs can be significantly reduced without any loss in quality.

Still another advantage of this invention is that the snowplow assembly has a reduced weight.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
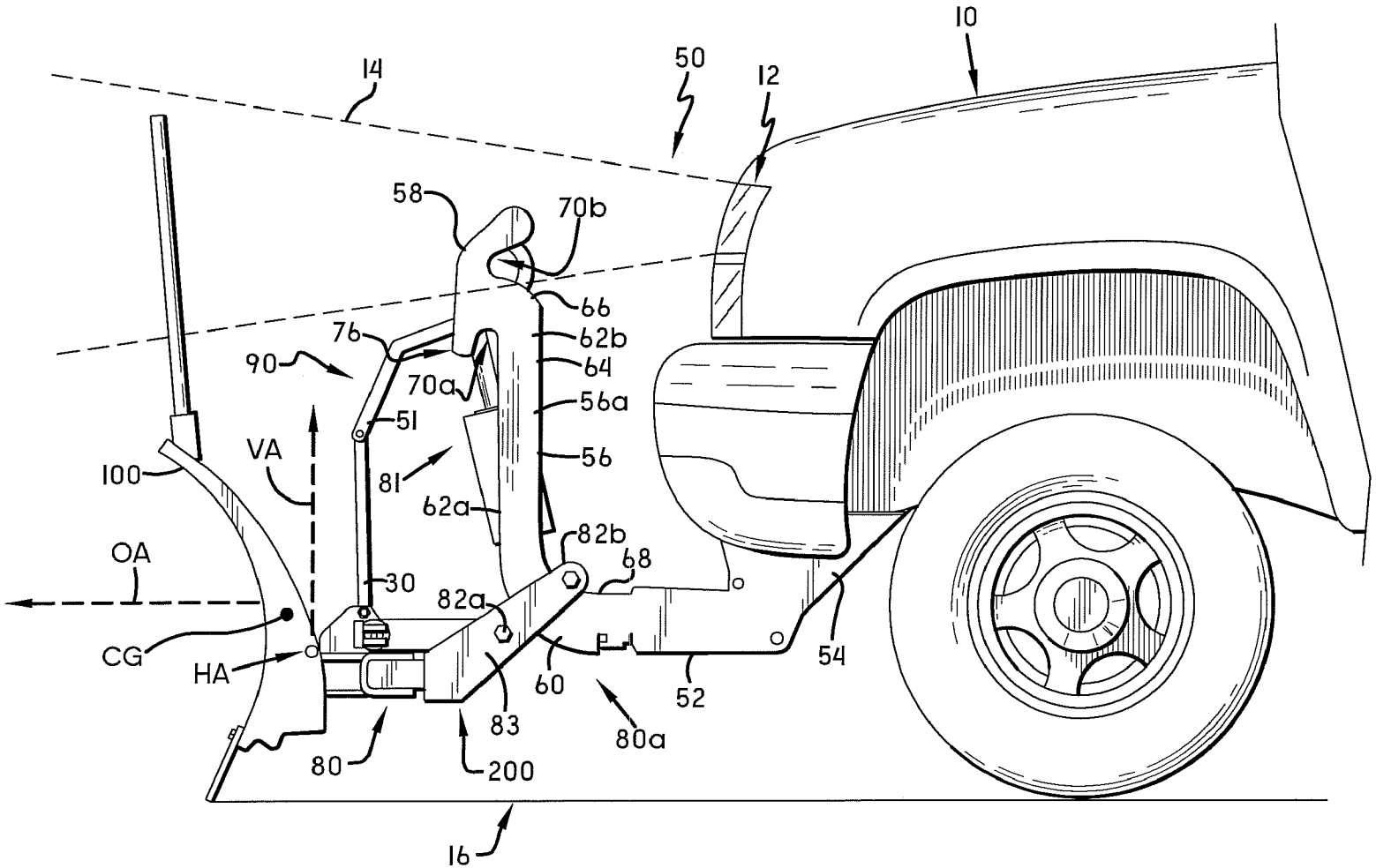
FIG. 1 is a side view of a vehicle equipped with a snowplow assembly according to this invention with the snowplow shown in the lowered, conventional plow position.
Figure 2:
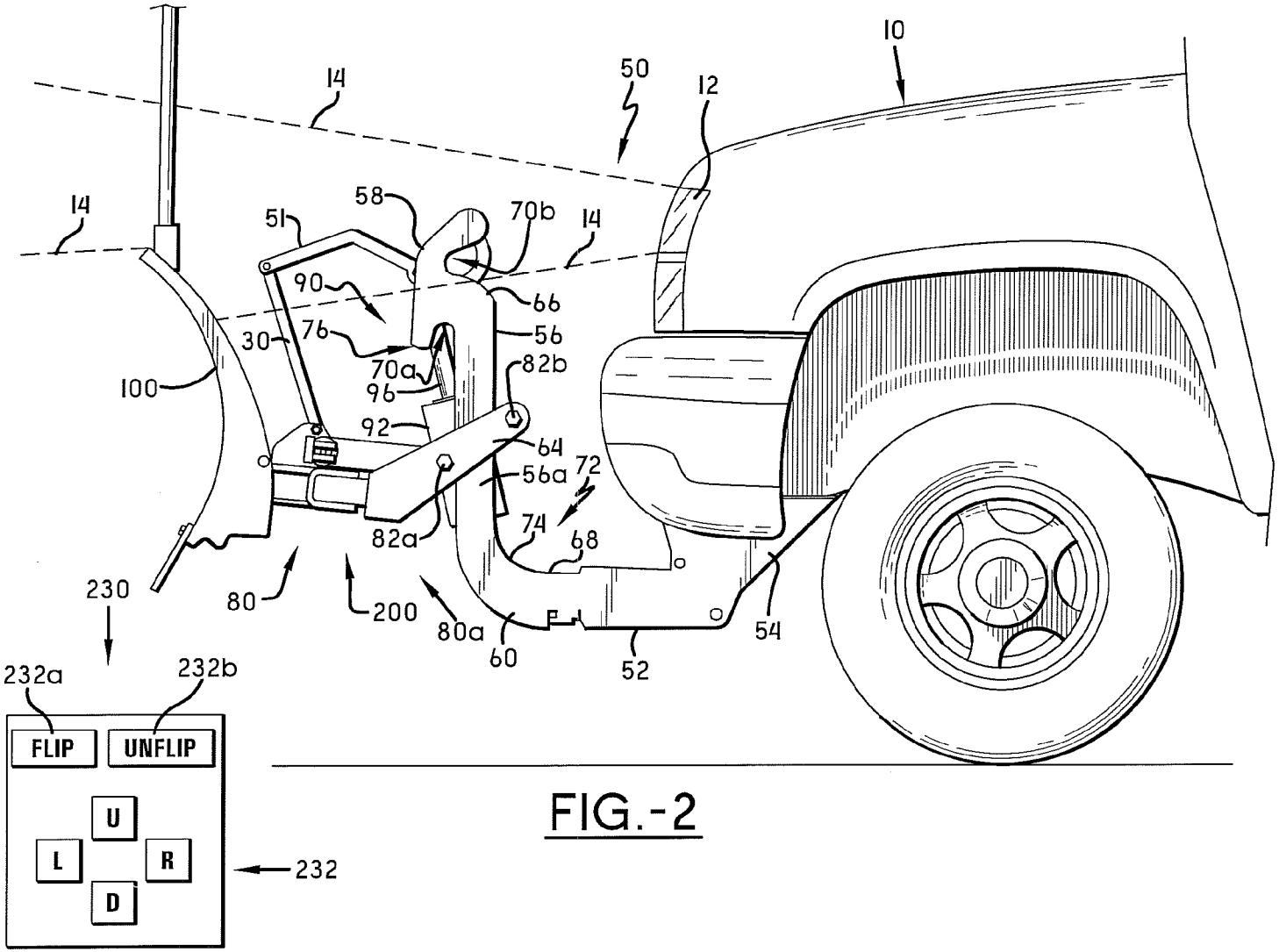
FIG. 2 is a side view similar to that shown in FIG. 1 but showing the snowplow in the partially raised position.
Figure 3:
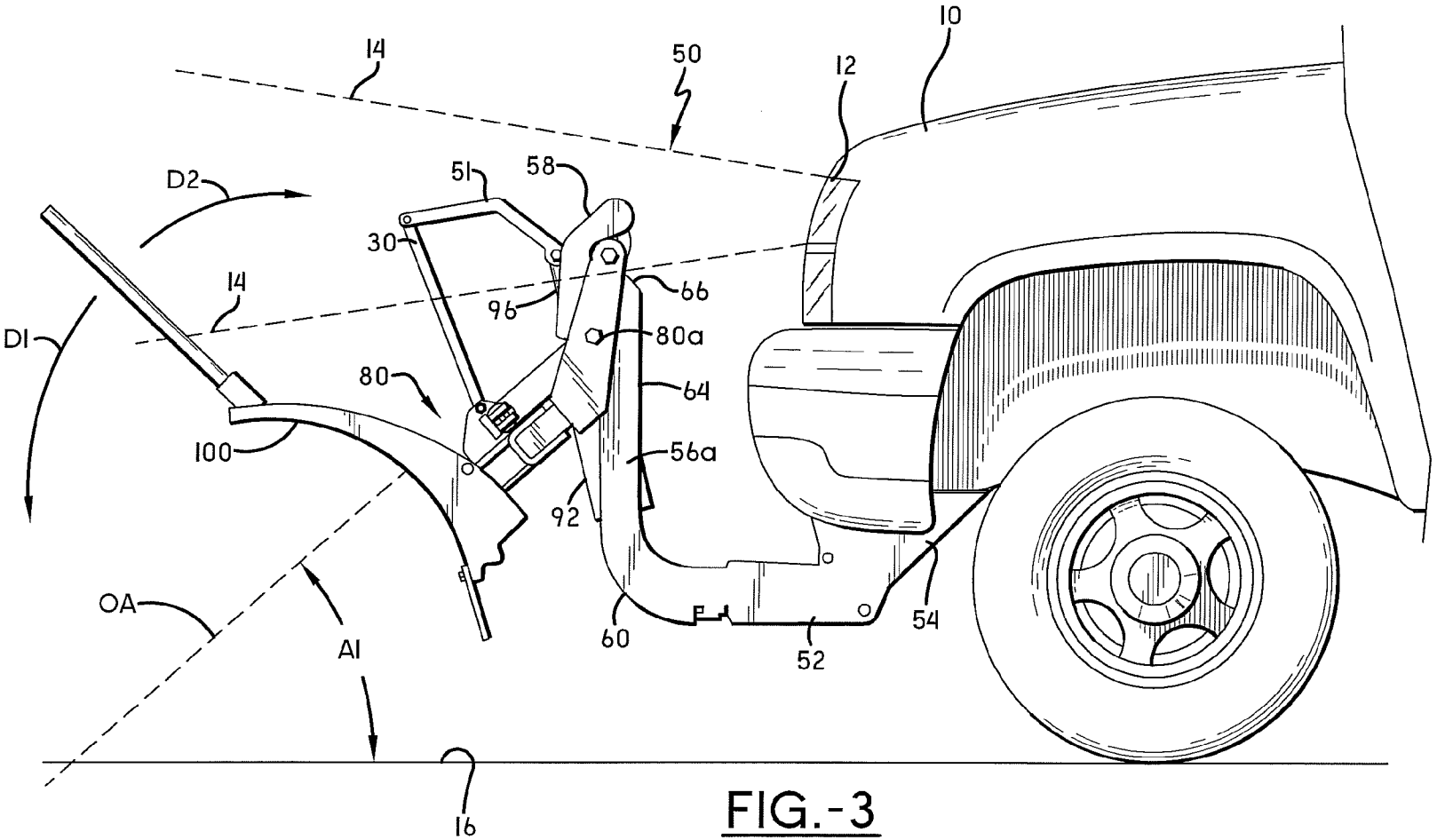
FIG. 3 is a side view similar to that shown in FIG. 1 but showing the snowplow in the raised and flipped position where the snowplow does not interfere with the headlight beams.
Figure 4:
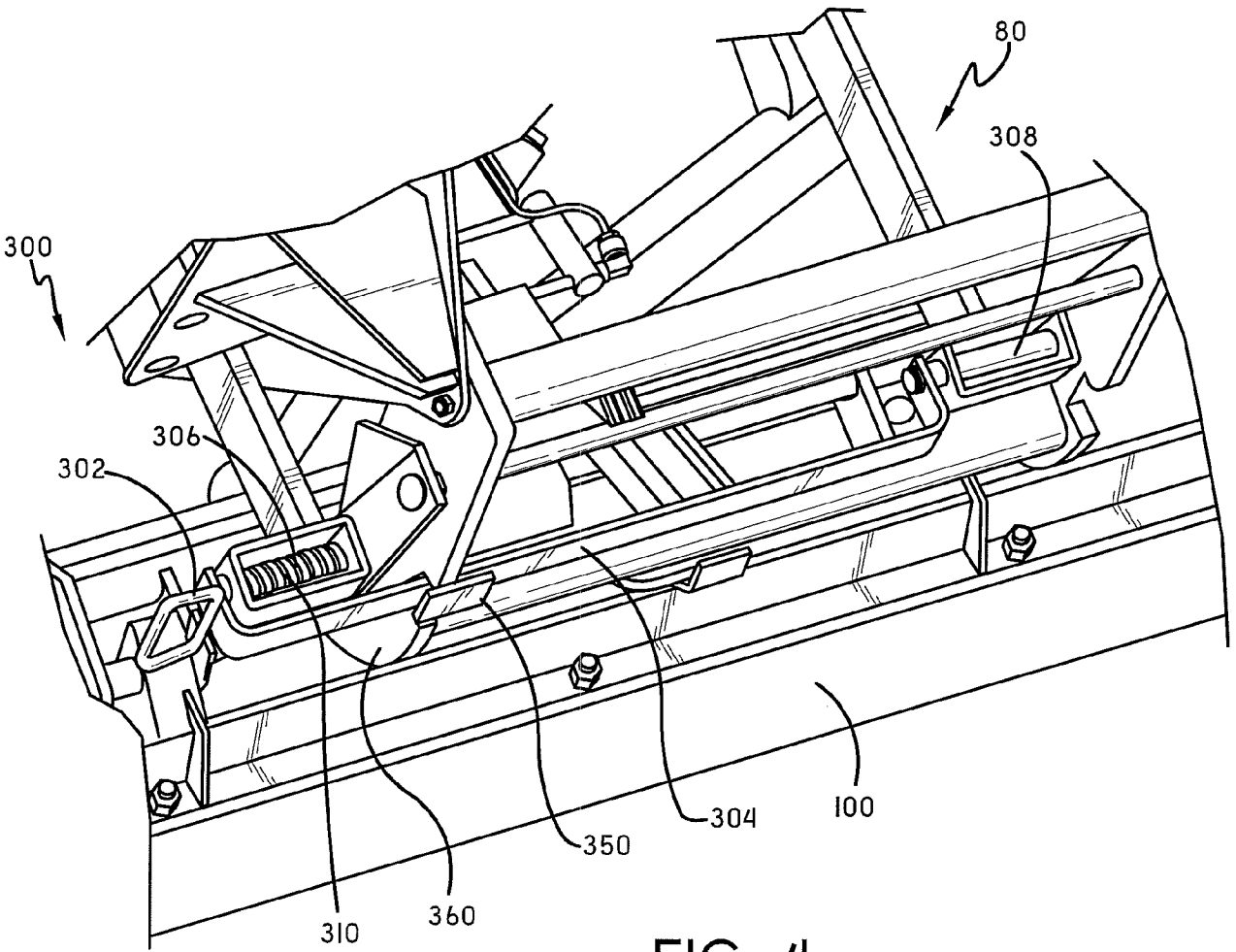
FIG. 4 is a side perspective view of a mechanism that may be used to attach the snowplow to the snowplow frame.

Referring now to the drawings wherein the showings are for purposes of illustrating various embodiments of the invention only and not for purposes of limiting the same, FIGS. 1-3 shows a snowplow assembly 50 including a snowplow 100 according to one embodiment of this invention. The snowplow assembly 50 may be attached to the front of a vehicle 10 which may be any type or size of vehicle that is adequately designed to carry the snowplow assembly 50. However, it should be noted that the snowplow assembly 50 of this invention is lighter than conventional snowplow assemblies and thus it can be mounted to and used also with vehicles not typically considered "snowplow ready," such as a Sport Utility Vehicle (SUV). The vehicle 10 includes conventional headlights (only one headlight 12 shown), each of which creates a headlight beam 14. The purpose for and use of headlights 12 are well known and thus will not be described in detail here.

With continuing reference to FIGS. 1-3, the snowplow assembly 50 may include a support frame 52 that supports the snowplow 100 throughout its motion and when being transported. A vehicle mount structure 54 is not required for this invention but may be secured to the vehicle 10 in a known manner. In this case, the support frame 52, and thus the snowplow assembly 50, can be selectively attached to and detached from the vehicle mount structure 54 in any manner chosen with sound engineering judgment.

With reference now to FIGS. 1-3 and 5-10, the snowplow assembly 50 may also have at least one lift frame member 56, two shown 56*a*, 56*b*, used to adjust the height of the snowplow 100 as will be discussed further below. Each lift frame member 56 has a top portion 58 and a bottom portion 60. The bottom portion 60 may be operatively connected to the support frame 52 such as by welding, bolting or other known methods. In another embodiment, the lift frame member 56 may be made together with the support frame 52 as a single component. Each lift frame member 56 may have at least one track 62, two shown 62*a*, 62*b*, to receive a later to be described track engaging device 200. In one embodiment, the tracks 62*a*, 62*b* are formed on opposite outer side surfaces of the lift frame member 56. Each track 62 may be substantially S-shaped with a linear mid-portion 64 and oppositely curved upper and lower portions 66, 68. In one embodiment, the linear mid-portion 64 is substantially perpendicular to a ground surface 16. The upper portion 66 may be curved toward the snowplow 100 and the lower portion 68 may be curved away from the snowplow 100 for purposes to be described further below. Each track 62 may have a stop location 70 that is used to stop the motion of the track engaging device 200 upward along the track 62. 70*a* references the stop location for track 62*a* and 70*b* references the stop location for track 62*b*. In one embodiment, each stop location 70 includes a curved surface, as shown, but other methods of stopping the motion of the track engaging device 200 can also be used. At least a portion of the curved upper portion 66 may be used, in one embodiment, as the stop location 70. At least one of the tracks 62 may have a second stop location 72 that is used to stop the motion of the track engaging device 200 downward along the track 62, as will described further below. The second stop location 72 may also, in one embodiment, include a curved surface, as shown. In a more specific embodiment, the second stop location 72 may comprise a groove 74 formed in the surface of the track 62. Each lift frame member 56 may also have a contact surface 76 to be used as described further below. Where two lift frame members 56*a*, 56*b* are used, they may be positioned on opposite sides of the support frame 52. A support member 78 may be connected between the lift frame members 56*a*, 56*b* to add structurally stability to the unit. The support member 78 may also be used, in one embodiment, to assist with the lifting of the snowplow 100 as will be discussed below.

Figure 11:
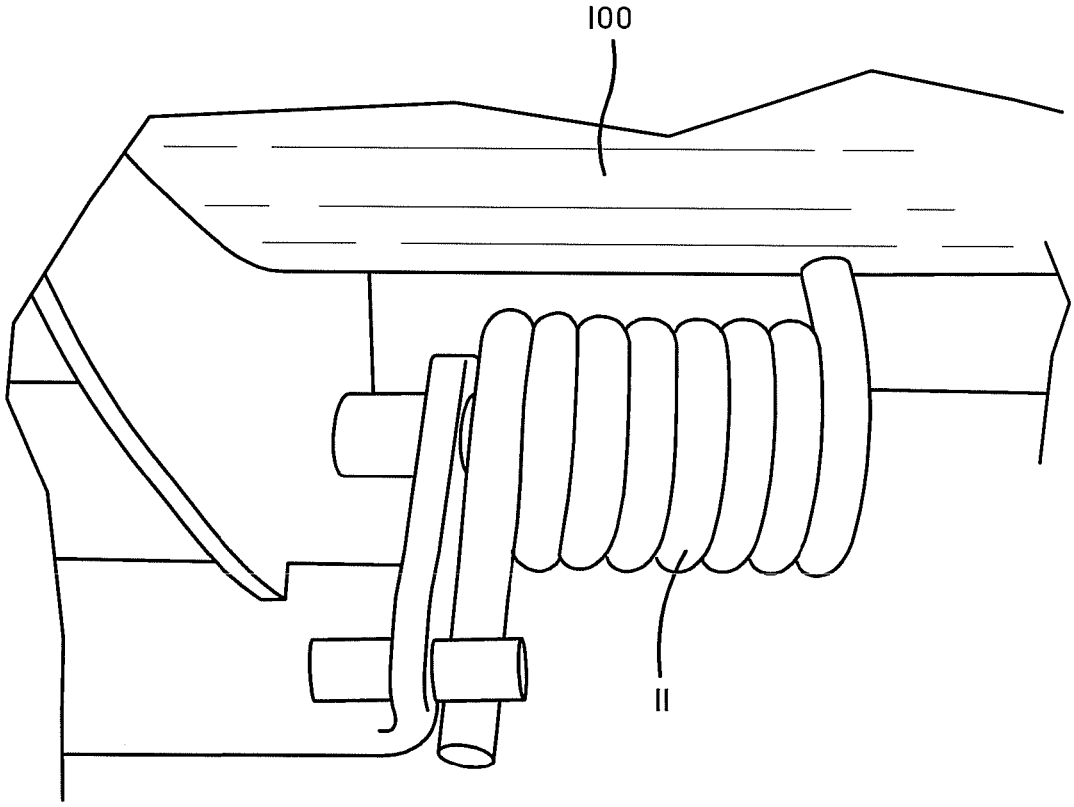
FIG. 11 is a top view of a torsion spring providing tripping action for the snowplow assembly shown in FIGS. 1-3.
Figure 12:
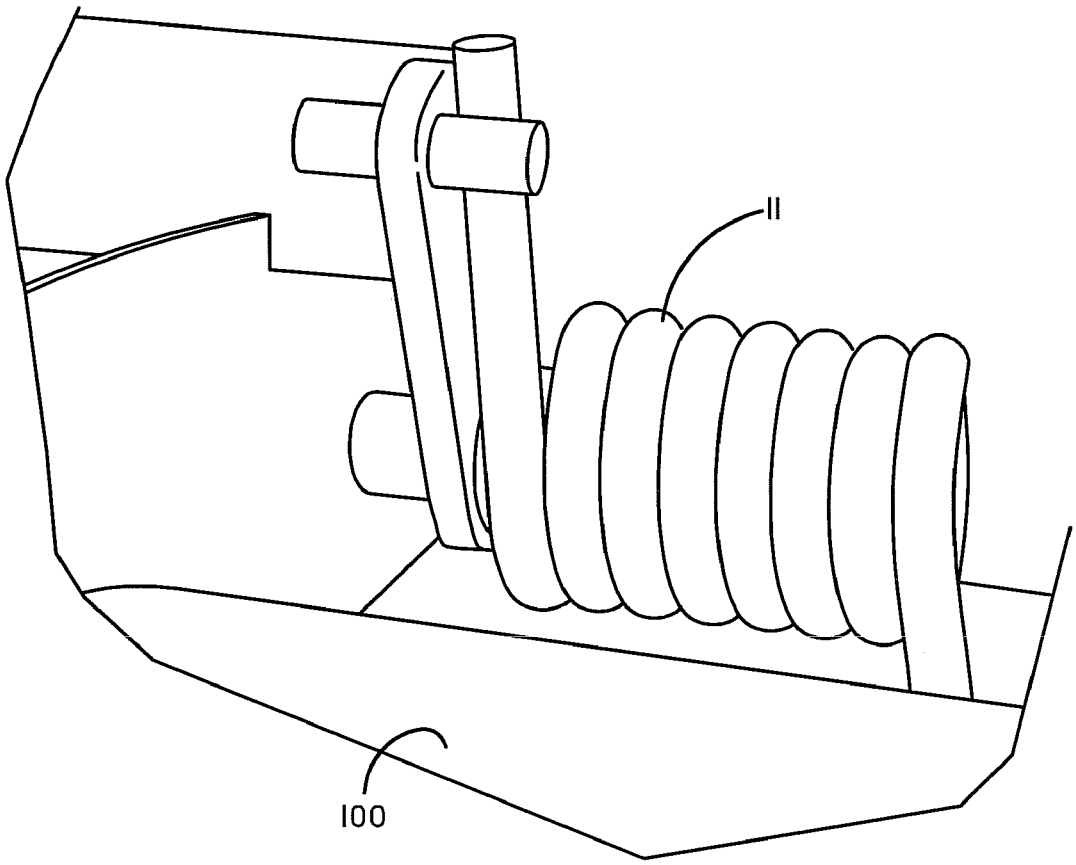
FIG. 12 is a side view of the torsion spring shown in FIG. 11.
Figure 13:
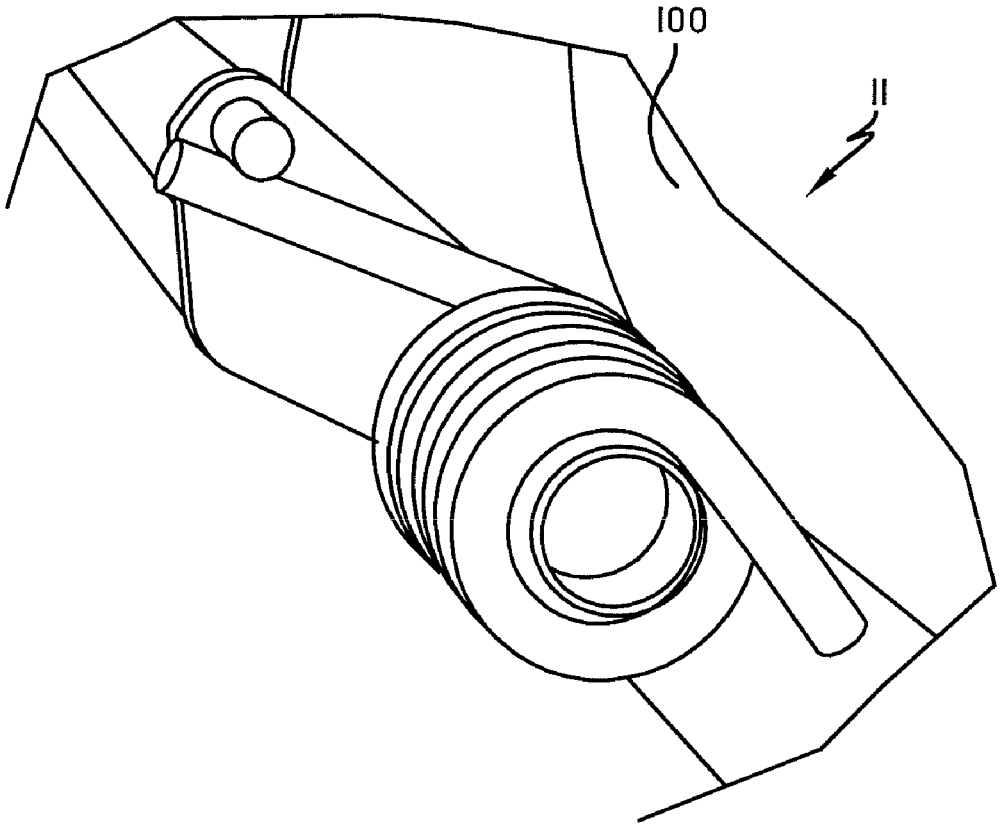
FIG. 13 is an end perspective view of the torsion spring shown in FIG. 11.
Figure 14:
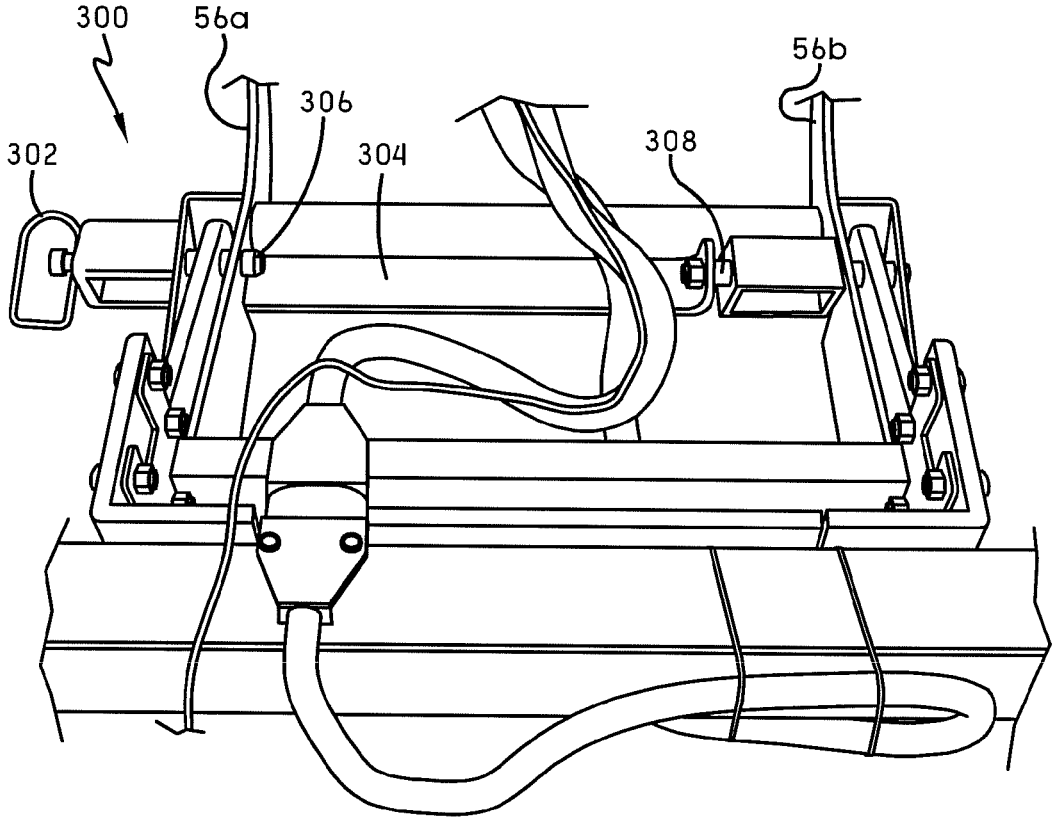
FIG. 14 is an end perspective view of the mechanism shown in FIG. 4.
Figure 15:
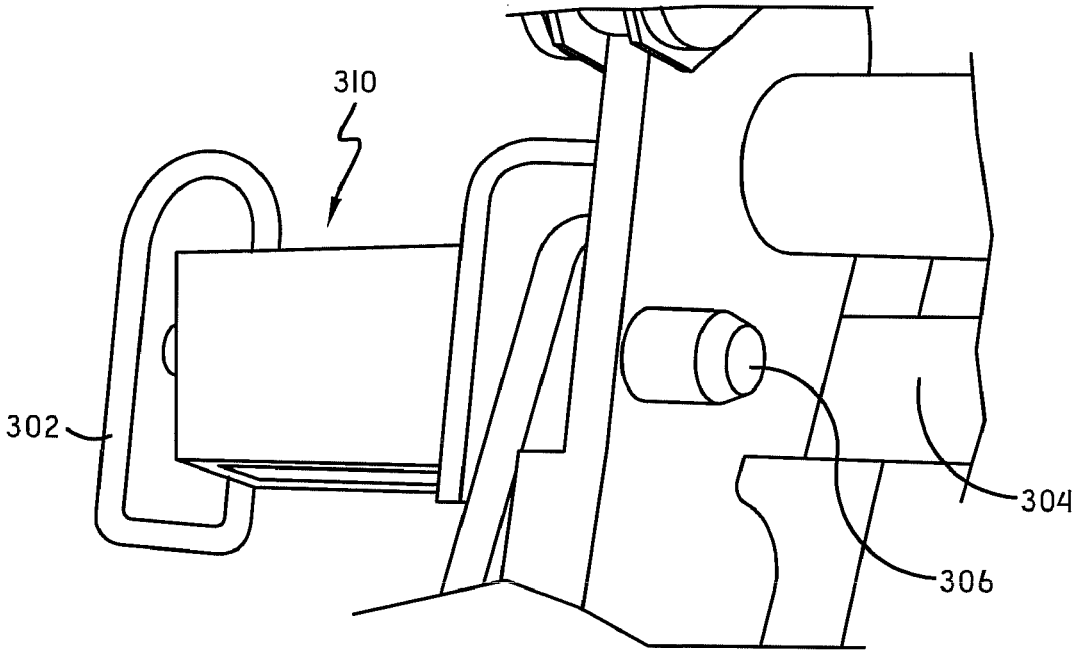
FIG. 15 is a close-up top perspective view of the mechanism shown in FIG. 4.
Figure 16:
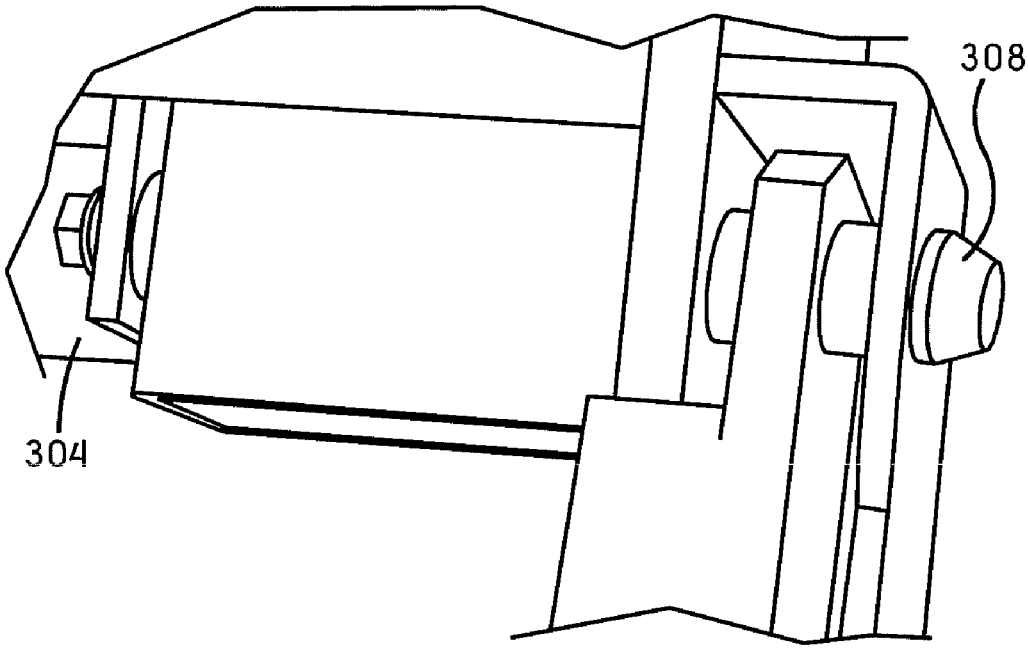
FIG. 16 is a close-up top perspective view of the mechanism shown in FIG. 4.

With continuing reference to FIGS. 1-3 and 5-10, the snowplow assembly 50 may also have a snowplow frame 80 used to support the snowplow 100 to the lift frame 56. The connection of the snowplow 100 to the snowplow frame member 80 can be any connection chosen with sound engineering judgment. The snowplow 100 may, for example, be movable about a vertical snowplow axis VA and/or movable about a horizontal axis HA (sometimes referred to as "tripping") as is well known by those of skill in the art. One embodiment of a torsion spring 11 that may be used with this invention is shown in FIGS. 11-13. The snowplow 100 has a snowplow operation axis OA that is substantially parallel to the ground surface 16 when the snowplow 100 is being used to plow snow on the ground surface 16, assuming the plow is not tripping about the horizontal axis HA. The snowplow frame 80 may have at least one contact surface 81 that is used to contact the contact surface 76 of the lift frame member 56 as will be described further below. In one embodiment the contact surface 81 extends inwardly from one, or both snowplow frame 80*a*, 80*b*. In another embodiment, the contact surface 81 is an outer surface of a support member 83 that extends between the snowplow frame members 80*a*, 80*b*.

Still referring to FIGS. 1-3 and 5-10, the snowplow frame 80 may also include the previously noted track engaging device 200 to engage the track 62 (or tracks) of the lift frame 56. In one embodiment, shown, the snowplow frame 80 includes a snowplow frame member 80*a* that operatively engages the lift frame member 56*a* and a snowplow frame member 80*b* that operatively engages the lift frame member 56*b*. The snowplow frame members 80*a*, 80*b* may be moved along the tracks 62 of the lift frame members 56*a*, 56*b* using the track engaging device 200. More specifically, each snowplow frame member 80*a*, 80*b* may include a pair of connection devices 82*a*, 82*b* having track engaging surfaces that engage the tracks 62*a*, 62*b*. While the connection devices 82*a*, 82*b* can be of any design chosen with sound engineering judgment, for the embodiment shown, they comprise rollers 84*a*, 84*b* having surfaces that roll along the tracks 62*a*, 62*b*, respectively, as the snowplow frame 80 is moved relative to the lift frame 56.

With continuing reference to FIGS. 1-3 and 5-10, the snowplow assembly 50 may also have an adjustment mechanism 90 used to adjust the position of the snowplow frame 80, and thus the snowplow 100, on the lift frame 56. The adjustment mechanism 90 may include a lift cylinder 92 attached between the support frame 52 and the snowplow frame 80. The lift cylinder 92 may be a hydraulic cylinder and may be operated by a conventional hydraulic system (not shown). The particular connection between the lift cylinder 92 and the snowplow frame member 80 can be any chosen with sound engineering judgment. For the embodiment shown, a first link 30 is pivotally attached at one end to the snowplow frame 80 and pivotally attached at the opposite end to a second link 51. The second link 51 has one end pivotally attached to the first link 30 and the opposite end pivotally attached to the distal end of the rod 96 which extends from the lift cylinder 92.

Figure 5:
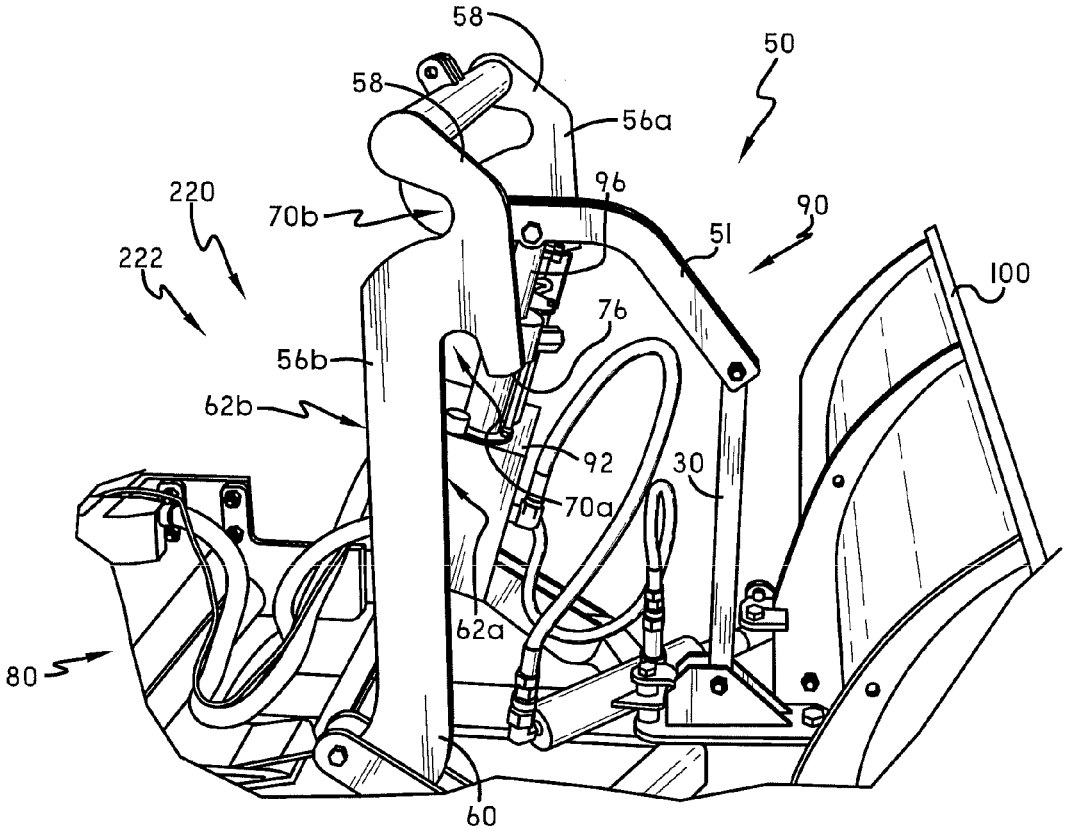
FIG. 5 is an opposite side perspective view of the snowplow assembly shown in FIGS. 1-3 showing the snowplow in the lowered position.
Figure 6:
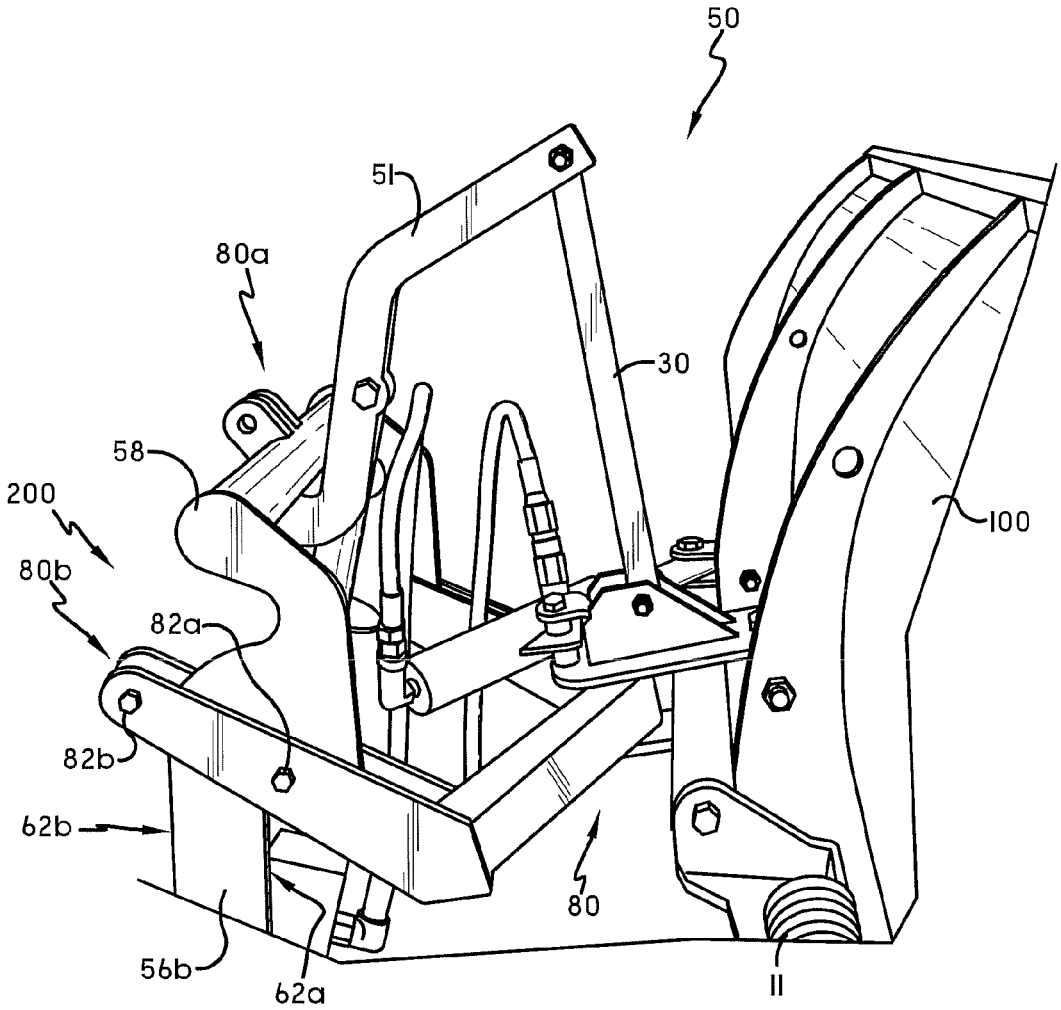
FIG. 6 is a close-up opposite side perspective view of the snowplow assembly shown in FIGS. 1-3 showing the snowplow in the raised but not flipped position.
Figure 7:
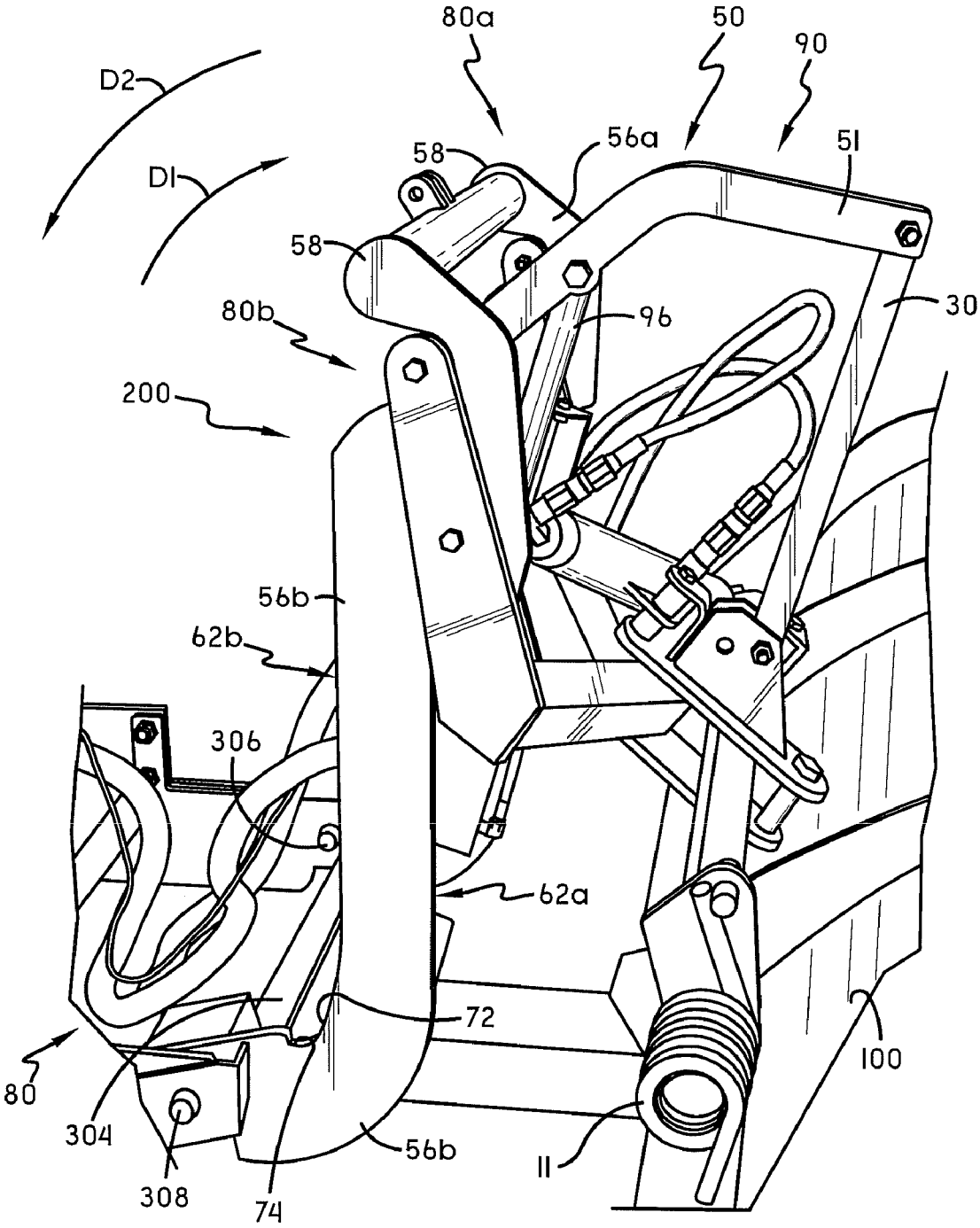
FIG. 7 is a close-up opposite side perspective view of the snowplow assembly shown in FIGS. 1-3 showing the snowplow in the raised and flipped position.
Figure 8:
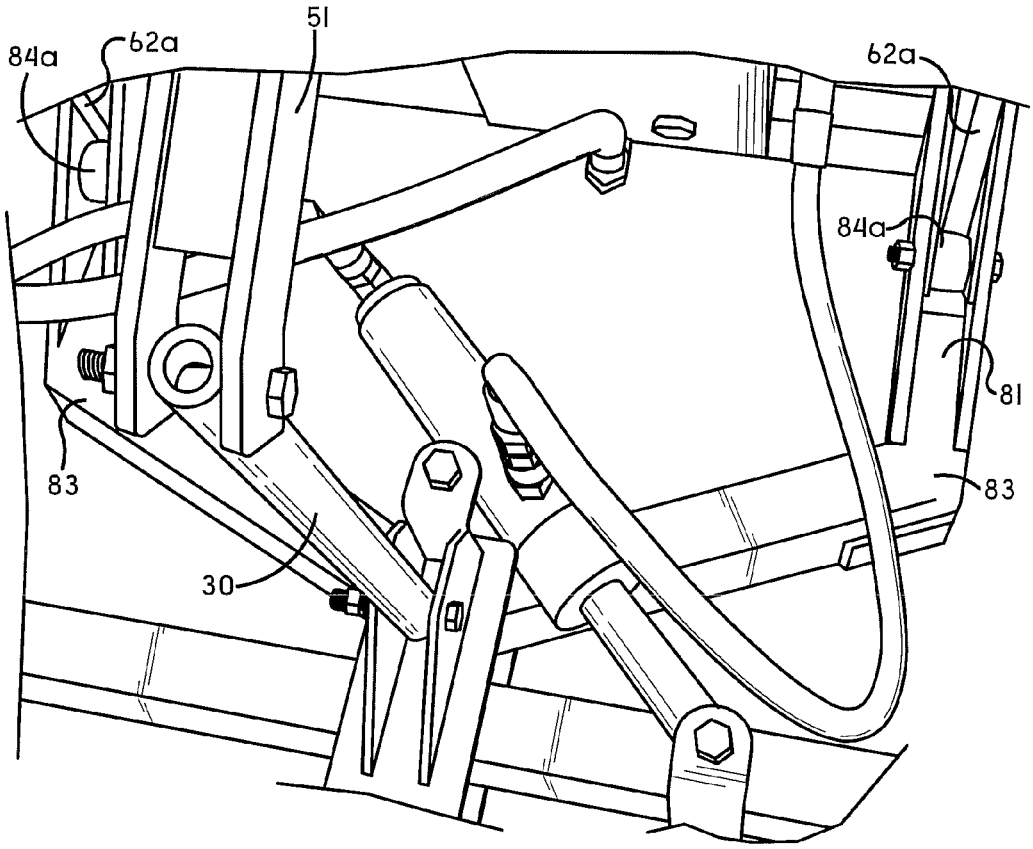
FIG. 8 is a top perspective view of a portion of the snowplow assembly shown in FIGS. 1-3.
Figure 9:
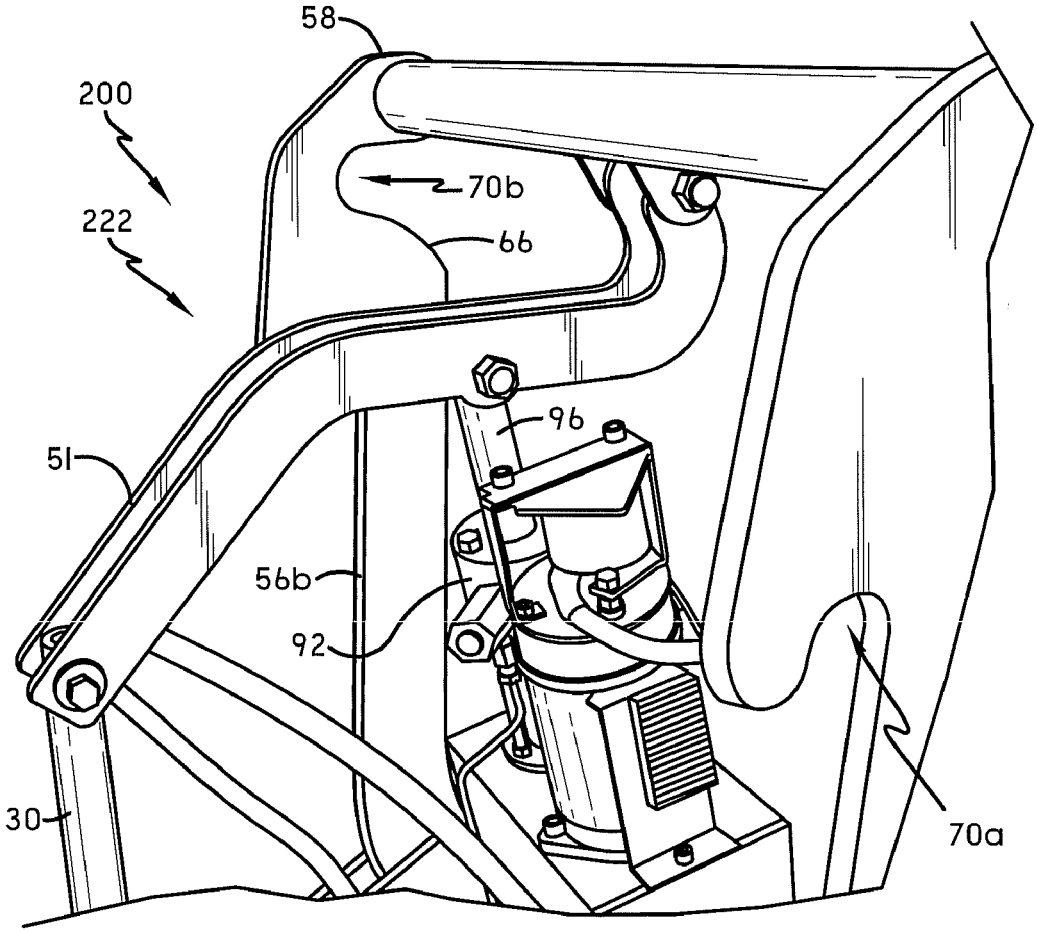
FIG. 9 is a side perspective view of a portion of the snowplow assembly shown in FIGS. 1-3.
Figure 10:
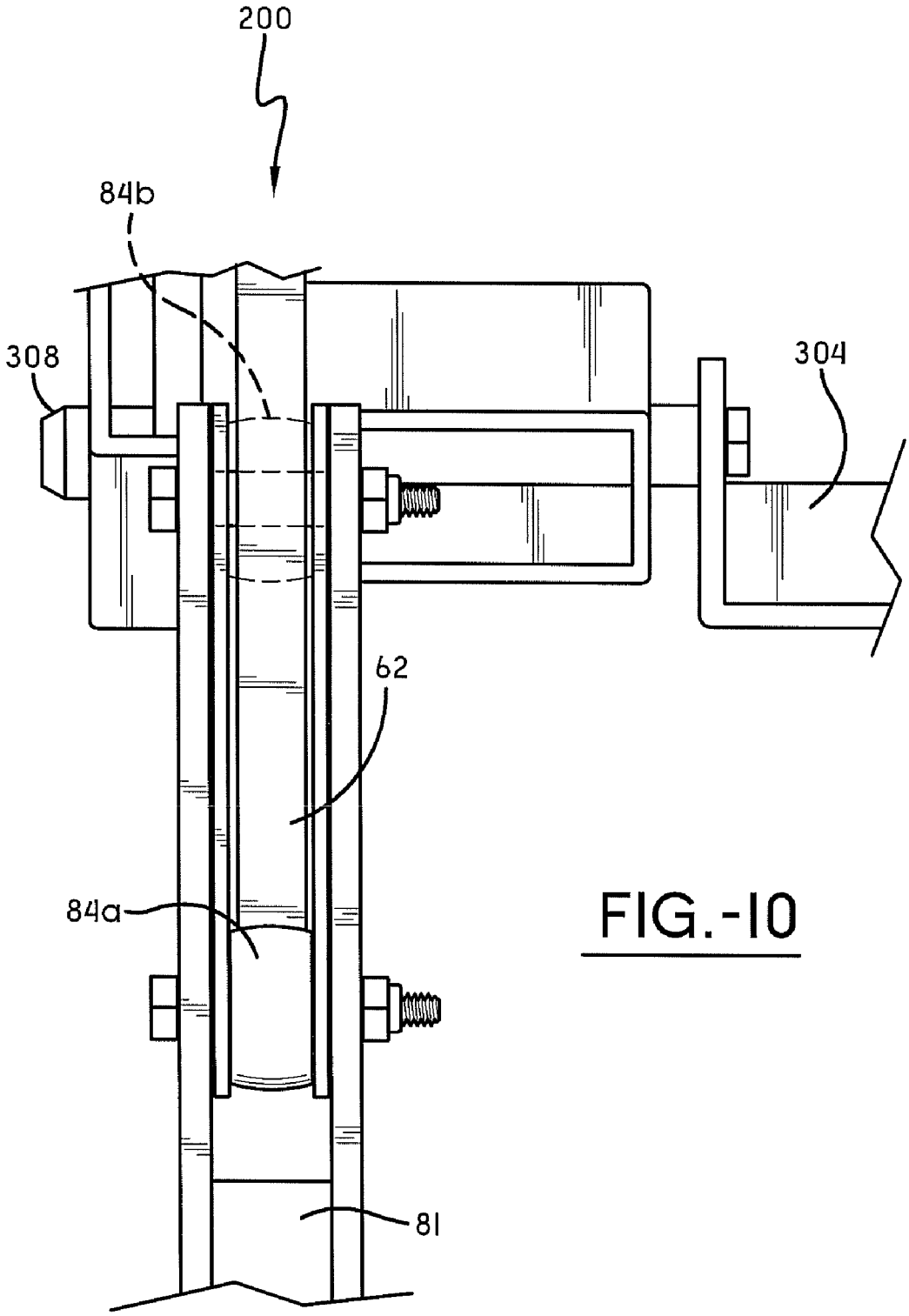
FIG. 10 is a close-up top view of a portion of the snowplow assembly shown in FIGS. 1-3.

With continuing reference to FIGS. 1-3 and 5-10, the adjustment mechanism 90 may be used to adjust the snowplow frame 80 and snowplow 100 into at least two positions. The first position, shown in FIGS. 1 and 5, is where the snowplow frame members 80*a*, 80*b*, are located on the bottom portions 60, 60 of the lift frame members 56*a*, 56*b*, the snowplow 100 is positioned to plow snow, and the snowplow operation axis OA is substantially parallel to the ground surface 16. By "positioned to plow snow" it is meant that the snowplow 100 is positioned to be used to plow snow from the ground surface 16 without need for any further adjustment relative to the lift frame 56. The second position, shown in FIGS. 3 and 7, is where the snowplow frame members 80*a*, 80*b*, are located on the top portions 58, 58 of the lift frame members 56*a*, 56*b* and the snowplow operation axis QA is at an angle A1 that is between 10° and 90° with respect to the ground surface 16. For the embodiment shown, the angle A1 is between 30° and 50°. The second position is ideal for transporting the snowplow assembly 50 to the next place of use. One benefit to adjusting the snowplow frame 80 and snowplow 100 into the second position is that in this position the snowplow 100 does not interfere with the headlight beams 14. As a result, there is no requirement for an auxiliary lighting system as part of the snowplow assembly 50, as is currently required. This reduces the cost of the snowplow assembly 50 and reduces the mass (weight) of the snowplow assembly 50 so that the snowplow assembly 50 can be used on vehicles not ordinarily thought of as being a good choice for snow plowing.

With continuing reference to FIGS. 1-3 and 5-10, the operation of the snowplow assembly 50 will now be described. To raise the snowplow frame 80 and the snowplow 100 from the conventional plow position, shown in FIGS. 1 and 5, the operator activates the lift cylinder 92 using a later to be described control system chosen with sounding engineering judgment, to lift the snowplow frame 80. The lift cylinder 92 causes the track engaging surfaces of the connection devices 82*a*, 82*b* to move upward along the tracks 62*a*, 62*b*. The generally vertical orientation of the mid-portions 64, 64 of the lift frame members 56*a*, 56*b* permits efficient raising of the snowplow 100. It should be noted that as the snowplow frame 80 and the snowplow 100 continue to be raised along the mid-portions 64, 64 the snowplow operation axis OA remains substantially parallel to the ground surface 16. As a result, the snowplow 100 reaches a position, shown in FIG. 2, where the snowplow 100 interferes with the headlight beams 14. Continued raising of the snowplow 100 causes each connection device 82*a* to move into the curved upper portion 66 of the track 62*a* and into the stop location 70*a*. Still further raising of the snowplow 100 causes the snowplow frame 80 to pivot in direction D1 about each connection device 82*a* (at this stage each connection device 82*a* ceases motion along the track 62*a* while each connection device 82*a* is position in stop location 70*a*). While the snowplow frame 80 pivots in direction D1 about each connection device 82*a*, each connection device 82*b* continues to move generally upward along track 82*b*. This motion continues until each connection device 82*b* moves into stop location 70*b*. This is the position shown in FIGS. 3 and 7. Note that in this position, the snowplow 100 does not interfere with the headlight beams 14. As a result, this is an ideal on vehicle "storage" position for transporting the vehicle 10 and the snowplow assembly 50.

With continuing reference to FIGS. 1-3 and 5-10, for the embodiment shown, the location of the center of gravity, labeled CG, for the portion of the snowplow assembly 50 that is position adjusted, ensures that the snowplow frame 80 will tend toward pivoting in direction A1 as the snowplow 100 is raised and lowered. This general location for the CG helps maintain the connection devices 82*a*, 82*b* against the tracks 62*a*, 62*b* as the snowplow 100 is raised and lowered. In order to prevent the snowplow frame 80 from pivoting toward the vehicle 10, a stop member 101, which in one embodiment is a bolt, is used. Should the snowplow frame 80 pivot to a certain extent, a portion of the snowplow assembly 50, in one embodiment the first link 30, will contact the stop member 101 and further pivoting motion is thus prevented.

With continuing reference to FIGS. 1-3 and 5-10, to lower the snowplow frame 80 and the snowplow 100 from the storage position, shown in FIGS. 3 and 7, the operator again activates the lift cylinder 92. As the lift cylinder 92 operates the snowplow frame 80 pivots in direction D2, opposite to direction D1, about each connection device 82*a* while each connection device 82*b* moves out of stop location 70*b* and then moves generally downward along track 82*b*. In one embodiment, the required operation of the lift cylinder 92 to cause the snowplow frame 80 to pivot in direction D2 is simply a lowering of the rod 96. In another embodiment, the required operation of the lift cylinder 92 to cause the snowplow frame 80 to pivot in direction D2 is a slight raising of the rod 96 that moves the connection device 82*b* out of stop location 82*b*. With this embodiment, as the snowplow frame 80 is being lifted, the contact surface 81 of the snowplow frame 80 may contact the contact surface 76 of the lift frame member 56. This contact makes it easier for the connection device 82*b* to come out of stop location 82*b* and move downwardly along track 62*b*. The lift cylinder 92 is then lowered. In either embodiment, continued lowering of the snowplow 100 permits the connection devices 82*a* to move downward along the tracks 62 through the mid-portions 64, 64 of the lift frame members 56*a*, 56*b* and to the lower portions 68, 68. As noted above, in one embodiment a track 62 may have a second stop location 72. For the embodiment shown in FIG. 3, the stop location 72 receives the connection device 82*b*. This permits the snowplow frame 80 to pivot about the connection device 82*b* in direction D2. This is useful when, for example, the ground surface 16 being plowed slopes downward from the front of the vehicle 10 and it is thus beneficial to permit the snowplow 100 to be angled below the position used when the ground surface 16 is relatively fiat or lever.

With reference now to FIGS. 1-3, the particular control system used to operate the snowplow assembly 50 can be any chosen with sound engineering judgment. In one embodiment the control system 220 includes a hydraulic system 222 and a controller 230. The hydraulic system 222 provides hydraulic fluid to operate the lift cylinder 92 and any other hydraulically activated components as is well known in the art. The controller 230 is the device that the operator uses to activate the hydraulic system 222 and thus the related hydraulic components and any other components as desired. The particular controller 230 can be of any conventional type such as a controller fixed within the operator compartment of the vehicle 10 or a controller that is not attached and thus easy for the operator to move, as desired. The controller 230 may be hard wired to the snowplow assembly 50 or may use radio frequency (RF) technology or other wireless technology. The controller 230 may include various conventional control buttons 232, including: (1) a control button which, when pressed, causes the snowplow 100 to pivot in a Left direction about vertical snowplow axis VA (it may be labeled "L", as shown); (2) a control button which, when pressed, causes the snowplow 100 to pivot in a Right direction about vertical snowplow axis VA (it may be labeled "R", as shown); (3) a control button which, when pressed, causes the snowplow 100 to move Upward (it may be labeled "U", as shown); and, (4) a control button which, when pressed, causes the snowplow 100 to move Downward (it may be labeled "D", as shown.)

With continuing reference to FIGS. 1-3, for the embodiment shown, the controller 230 includes two additional control buttons used with this invention. While the actual labeling may be any as desired, one control button 232*a* may be labeled "Flip" and the other control button 232*b* "Unflip." The Flip button 232*a* is pressed by the operator when it is desired to adjust the snowplow 100 into the second position shown in FIG. 3. In this case, the snowplow 100 is not only raised but the snowplow frame 80 is pivoted (flipped) about connection devices 82*a* in direction D1 as explained above. The Unflip button 232*b* is pressed by the operator when it is desired to adjust the snowplow 100 out of the second position shown in FIG. 3. In this case, the snowplow frame 80 is pivoted (unflipped) about connection devices 82*a* in direction D2 as explained above. Pressing one or both buttons 232*a*, 232*b* may activate a timer along with the appropriate hydraulics to perform the required function. Pressing the Unflip button 232*b*, for example, may cause the snowplow frame 80 to raise for three (3) seconds (or some other predetermined time) to permit the snowplow frame 80 to pivot as described above.

With reference now to FIGS. 4, 7, 10 and 14-16, the snowplow assembly 50 may include other components and operations not yet described. A pin pull mechanism 300 may be used to attach the snowplow 100 to the snowplow frame 80. Handle 302 is used to pull bar 304 which is connected to pins 306 and 308. A spring 310 may be used to keep the pins 306, 308 biased toward the attached position. To detach the snowplow 100, the handle 302 is pulled against the spring 310 force. This causes pull bar 304 to move and the pins 306, 308 are released enough to detach the snowplow 100. More specifically, when the pull bar 304 is moved, a surface 350 goes beyond surface 360. At this point, the pins 306, 308 can be rotated clockwise (as shown) 10 or 20 degrees or so to lock onto surface 360. To put the pin back in, you rotate it back counterclockwise and it will snap back in.

Figure 17:
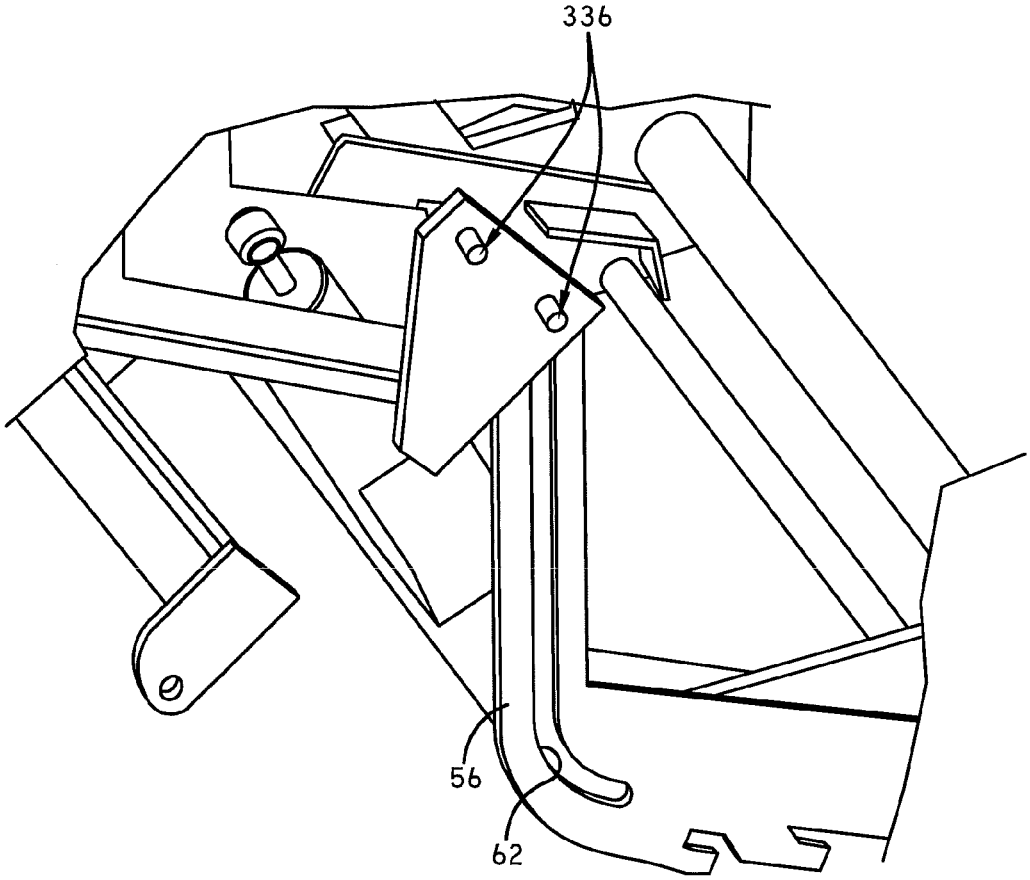
FIG. 17 is side perspective view showing another embodiment

With reference now to FIG. 17, in yet another embodiment, each lift frame member 56*a*, 56*b* may have a partially enclosed track 62, as shown. Each lift frame member 56*a*, 56*b* may have a track 62 on one side thereof. The snowplow frame 80 is connected to the track 62 so that the snowplow frame 80, and thus the snowplow 100, can be moved along the track 62. The snowplow frame member 80 may have a pair of connection points 336, 336 that are received within the track 62. The connection points 336, 336 can be of any design chosen with sound engineering judgment such as rollers, as shown. The connection points 336, 336 can be moved along the track 62 similar to the manner described above.

Various embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

I claim:

1. A method of adjusting a snowplow comprising the steps of:

(a) providing a snowplow assembly comprising: (1) a support frame for use in connecting the snowplow assembly to an associated vehicle; (2) at least one lift frame member having a top portion and a bottom portion operatively connected to the support frame; (3) at least one snowplow frame member that engages the lift frame member; (4) a snowplow operatively connected to the snowplow frame member and having a snowplow operation axis; and, (5) an adjustment mechanism for use in adjusting the position of the snowplow frame member on the lift frame member;

(b) lowering the snowplow frame member to the bottom portion of the lift frame member where the snowplow is positioned to plow snow and the snowplow operation axis is substantially parallel to a ground surface;

(c) raising the snowplow frame member to the top portion of the lift frame member; and, (d) pivoting the snowplow frame member on the top portion of the lift frame member where the snowplow operation axis is at an angle A1 that is between 10° and 90° with respect to the ground surface.

2. The method of claim 1 wherein:

step (a)(2) comprises the step of providing the lift frame member with at least a first track;

step (a)(3) comprises the step of providing the snowplow frame member with at least a first track engaging surface that engages the first track; and, step (d) comprises the step of pivoting the snowplow frame member about the first track engaging surface.

3. The method of claim 1 wherein:

step (a)(2) comprises the step of providing the lift frame member with first and second tracks each having a stop location;

step (a)(3) comprises the step of providing the snowplow frame member with first and second track engaging surfaces that engage the first and second tracks, respectively; and, step (d) comprises the sequential steps of:

(1) engaging the first track engaging surface with the stop location on the first track;

(2) moving the second track engaging surface along the second track; and, (3) engaging the second track engaging surface with the stop location on the second track.

4. The method of claim 1 wherein after step (d), the method comprises the steps of:

pivoting the snowplow frame member on the top portion of the lift frame member in a direction opposite to that in step (d); and, lowering the snowplow frame member to the bottom portion of the lift frame member.

5. The method of claim 4 wherein:

step (a)(2) comprises the step of providing the lift frame member with a contact surface;

step (a)(3) comprises the step of providing the snowplow frame member with a contact surface; and, the step of, pivoting the snowplow frame member on the top portion of the lift frame member in a direction opposite to that in step (d), comprises the step of contacting the contact surface of the snowplow frame member with the contact surface of the lift frame member.

6. A snowplow assembly comprising:

a support frame for use in connecting the snowplow assembly to an associated vehicle;

a first lift frame member having a top portion and a bottom portion operatively connected to the support frame;

a first snowplow frame member that engages the first lift frame member;

a snowplow operatively connected to the first snowplow frame member and having a snowplow operation axis; and, an adjustment mechanism for use in adjusting the position of the first snowplow frame member on the first lift frame member into at least two positions:

(1) a first position where the first snowplow frame member is on the bottom portion of the first lift frame member, the snowplow is positioned to plow snow, and the snowplow operation axis is substantially parallel to a ground surface; and, (2) a second position where the first snowplow frame member is on the top portion of the first lift frame member and the snowplow operation axis is at an angle A1 that is between 10° and 90° with respect to the ground surface.

7. The snowplow assembly of claim 6 wherein:

the first lift frame member comprises first and second tracks; and, the first snowplow frame member comprises first and second track engaging surfaces that engage the first and second tracks, respectively.

8. The snowplow assembly of claim 7 wherein:

the first and second tracks each comprise a stop location; and, the first track engaging surface is engaged at the stop location on the first track while the second track engaging surface is engaged at the stop location on the second track when the first snowplow frame member is in the second position.

9. The snowplow assembly of claim 8 wherein each of the stop locations comprise a curved surface.

10. The snowplow assembly of claim 6 further comprising:

a second lift frame member having a top portion and a bottom portion operatively connected to the support frame;

a second snowplow frame member that engages the second lift frame member;

wherein the snowplow is operatively connected to the second snowplow frame member;

wherein the adjustment mechanism is for use in adjusting the position of the second snowplow frame member on the second lift frame member into at least two positions:

(1) a first position where the second snowplow frame member is on the bottom portion of the second lift frame member, the snowplow is positioned to plow snow, and the snowplow operation axis is substantially parallel to the ground surface; and, (2) a second position where the second snowplow frame member is on the top portion of the second lift frame member and the snowplow operation axis is at the angle A1 that is between 10° and 90° with respect to the ground surface.

11. The snowplow assembly of claim 10 further comprising:

a support member having a first end attached to the first snowplow frame member and a second end attached to the second snowplow frame member, the support member also having a first contact surface adapted to contact a first contact surface formed on the first lift frame member and a second contact surface adapted to contact a second contact surfaced formed on the second lift frame member.

12. The snowplow assembly of claim 6 wherein when the first snowplow frame member is in the second position, the snowplow operation axis is at an angle A1 that is between 30° and 50° with respect to the ground surface.

13. A method of adjusting a snowplow comprising the steps of:

(a) providing a snowplow assembly comprising: (1) a support frame for use in connecting the snowplow assembly to an associated vehicle; (2) at least one lift frame member operatively connected to the support frame; (3) at least one snowplow frame member that engages the lift frame member; (4) a snowplow operatively connected to the snowplow frame member; and, (5) an adjustment mechanism for use in adjusting the position of the snowplow frame member on the lift frame member;

(b) connecting the snowplow assembly to a vehicle having a first head light providing a first headlight beam;

(c) lowering the snowplow frame member to a first position where the snowplow is positioned to plow snow;

(d) raising the snowplow frame member to a second position where the snowplow substantially interferes with the first headlight beam; and, (e) after step (d), further raising at least a portion of the snowplow frame member to a third position where the snowplow does not substantially interfere with the first headlight beam.

14. The method of claim 13 wherein:

step (a)(2) comprises the step of providing the lift frame member with at least a first track;

step (a)(3) comprises the step of providing the snowplow frame member with at least a first track engaging surface that engages the first track; and, step (e) comprises the step of pivoting the snowplow frame member about the first track engaging surface.

15. The method of claim 13 wherein:

step (a)(2) comprises the step of providing the lift frame member with first and second tracks each having a stop location;

step (a)(3) comprises the step of providing the snowplow frame member with first and second track engaging surfaces that engage the first and second tracks, respectively; and, step (e) comprises the sequential steps of:

(1) engaging the first track engaging surface with the stop location on the first track;

(2) moving the second track engaging surface along the second track; and, (3) engaging the second track engaging surface with the stop location on the second track.

16. The snowplow assembly comprising:

a support frame for use in connecting the snowplow assembly to an associated vehicle having a first head light providing a first headlight beam;

a first lift frame member having a top portion and a bottom portion operatively connected to the support frame;

a first snowplow frame member that engages the first lift frame member;

a snowplow operatively connected to the first snowplow frame member and having a snowplow operation axis; and, an adjustment mechanism for use in adjusting the position of the first snowplow frame member on the first lift frame member into at least three positions:

(1) a first position where the first snowplow frame member is on the bottom portion of the first lift frame member and the snowplow is positioned to plow snow;

(2) a second position where the first snowplow frame member is on the top portion of the first lift frame member and the snowplow would substantially interfere with the first headlight beam; and (3) a third position where the first snowplow frame member is on the top portion of the first lift frame member and the snowplow would not substantially interfere with the first headlight beam.

17. The snowplow assembly of claim 16 wherein:

the first lift frame member comprises first and second tracks; and, the first snowplow frame member comprises first and second track engaging surfaces that engage the first and second tracks, respectively.

18. The snowplow assembly of claim 17 wherein:

the first and second tracks each comprise a stop location; and, the first track engaging surface is engaged at the stop location on the first track while the second track engaging surface is engaged at the stop location on the second track when the first snowplow frame member is in the third position.

19. The snowplow assembly of claim 18 wherein each of the stop locations comprise a curved surface.

20. The snowplow assembly of claim 16 further comprising:

wherein the associated vehicle also has a second head light providing a second headlight beam;

a second lift frame member having a top portion and a bottom portion operatively connected to the support frame;

a second snowplow frame member that engages the second lift frame member; wherein the snowplow is operatively connected to the second snowplow frame member;

wherein the adjustment mechanism is for use in adjusting the position of the second snowplow frame member on the second lift frame member into at least two positions:

(1) a first position where the second snowplow frame member is on the bottom portion of the second lift frame member and the snowplow is positioned to plow snow;

(2) a second position where the second snowplow frame member is on the top portion of the second lift frame member and the snowplow would substantially interfere with the second headlight beam; and (3) a third position where the second snowplow frame member is on the top portion of the second lift frame member and the snowplow would not substantially interfere with the second headlight beam.

21. The snowplow assembly of claim 20 further comprising:

a support member having a first end attached to the first snowplow frame member and a second end attached to the second snowplow frame member, the support member also having a first contact surface adapted to contact a first contact surfaced formed on the first lift frame member and a second contact surface adapted to contact a second contact surfaced formed on the second lift frame member.

22. A method of adjusting a snowplow comprising the steps of:

(a) providing a snowplow assembly comprising: (1) a support frame for use in connecting the snowplow assembly to an associated vehicle; (2) at least one lift frame member having a top portion and a bottom portion operatively connected to the support frame; (3) at least one snowplow frame member that engages the lift frame member; (4) a snowplow operatively connected to the snowplow frame member; and, (5) an adjustment mechanism for use in adjusting the position of the snowplow frame member on the lift frame member;

(b) connecting the snowplow assembly to a vehicle having a first head light providing a first headlight beam;

(c) lowering the snowplow frame member to the bottom portion of the lift frame member where the snowplow is positioned to plow snow;

(d) raising the snowplow frame member to the top portion of the lift frame member where the snowplow substantially interferes with the first headlight beam; and, (e) pivoting the snowplow frame member on the top portion of the lift frame member where the snowplow does not substantially interfere with the first headlight beam.

23. The method of claim 22 wherein:

step (a)(2) comprises the step of providing the lift frame member with at least a first track;

step (a)(3) comprises the step of providing the snowplow frame member with at least a first track engaging surface that engages the first track; and, step (e) comprises the step of pivoting the snowplow frame member about the first track engaging surface.

24. The method of claim 23 wherein after step (e) the method comprises the steps of:

pivoting the snowplow frame member on the top portion of the lift frame member in a direction opposite to that in step (e); and, lowering the snowplow frame member to the bottom portion of the lift frame member.

25. The method of claim 24 wherein:

step (a)(2) comprises the step of providing the lift frame member with a contact surface;

step (a)(3) comprises the step of providing the snowplow frame member with a contact surface; and, the step of, pivoting the snowplow frame member on the top portion of the lift frame member in a direction opposite to that in step (e), comprises the step of contacting the contact surface of the snowplow frame member with the contact surface of the lift frame member.

26. The method of claim 22 wherein:

step (a)(2) comprises the step of providing the lift frame member with first and second tracks each having a stop location;

step (a)(3) comprises the step of providing the snowplow frame member with first and second track engaging surfaces that engage the first and second tracks, respectively; and, step (e) comprises the sequential steps of:

(1) engaging the first track engaging surface with the stop location on the first track;

(2) moving the second track engaging surface along the second track; and, (3) engaging the second track engaging surface with the stop location on the second track.

* * * * *